US007201679B2

(12) United States Patent
Nguyen

(10) Patent No.: US 7,201,679 B2
(45) Date of Patent: Apr. 10, 2007

(54) SECTIONAL VIBRATION DAMPING, FLEXIBLE BAT

(76) Inventor: Thu Van Nguyen, 24128 Hillhurst Dr., West Hills, CA (US) 91307

( * ) Notice: Subject to any disclaimer, the term of this patent is extended or adjusted under 35 U.S.C. 154(b) by 55 days.

(21) Appl. No.: 11/121,503

(22) Filed: May 3, 2005

(65) Prior Publication Data

US 2006/0252586 A1 Nov. 9, 2006

(51) Int. Cl.
*A63B 59/06* (2006.01)

(52) U.S. Cl. ..... 473/520; 473/566; 473/564; 473/567; 473/519

(58) Field of Classification Search ..... 473/564–568, 473/457, 519, 520
See application file for complete search history.

(56) References Cited

U.S. PATENT DOCUMENTS 537,927 A * 4/1895 Kennedy ..... 473/520
546,540 A * 9/1895 Kennedy ..... 473/520
1,509,733 A * 9/1924 Langford ..... 473/520
3,877,698 A * 4/1975 Volpe ..... 473/520
5,219,164 A * 6/1993 Peng ..... 473/520
5,409,214 A 4/1995 Cook
5,516,097 A * 5/1996 Huddleston ..... 473/457
5,524,884 A * 6/1996 Haines ..... 473/521
5,593,158 A 1/1997 Filice et al.
6,050,908 A * 4/2000 Muhlhausen ..... 473/457
6,485,382 B1 11/2002 Chen
6,511,392 B1 1/2003 Chohan
6,625,848 B1 * 9/2003 Schneider ..... 16/436
6,702,698 B2 3/2004 Eggiman et al.
6,863,628 B1 * 3/2005 Brandt ..... 473/520
6,878,080 B2 * 4/2005 Chang ..... 473/564
2003/0158006 A1 * 8/2003 Tribble ..... 473/564
2004/0224802 A1 * 11/2004 Forsythe et al. ..... 473/564
2005/0143203 A1 * 6/2005 Souders et al. ..... 473/564

* cited by examiner

*Primary Examiner*—Mark S. Graham
(74) *Attorney, Agent, or Firm*—Kelly Lowry & Kelley LLC

(57) ABSTRACT

A vibration damping baseball bat includes a barrel portion and a handle portion. The barrel portion and the handle portion are interconnected in an aligned and spaced-apart relation. The mechanism by which the barrel and handle portions are interconnected dampens vibrations created when a ball contacts the bat and provides limited pivotal movement of the barrel portion relative to the handle portion.

27 Claims, 8 Drawing Sheets

SECTIONAL VIBRATION DAMPING, FLEXIBLE BAT

BACKGROUND OF THE INVENTION

The present invention relates to baseball and softball bats. More particularly, the present invention relates to a bat having a vibration damping, flexible structure between the grip and the head of the bat.

Baseball and softball are very popular sports in the United States, Mexico, Cuba, Japan and elsewhere. Due to the competitive nature of the sports, players are constantly seeking ways of improving their performance. An important aspect of baseball and softball is the ability to effectively hit the ball. Aluminum (metal) bats are allowed in baseball amateur play from Little League to College levels. Metal bats are also typically used in slow and fast pitch softball. Such bats are advantageous over wood bats in that they do not break and splinter like wood bats and thus can be repeatedly used with consequent cost savings. Metal bats also have a larger optimal hitting area or power zone (commonly referred to as the "sweet spot") than wood bats. Furthermore, the ball comes off a metal bat faster than a wood bat resulting in longer hits.

However, metal bats have certain disadvantages. Metal bats vibrate upon impact and may send painful vibrations into the hands and arms of the batter if the ball is not hit within the power zone of the bat. Metal bats, particularly aluminum bats, may also dent or otherwise deform due to forceful impacts with the ball. Metal bats also emit an undesirable high-pitched metallic sound, as opposed to the traditional sound heard when a wood bat contacts the ball.

Various attempts have been made to overcome the problems associated with metal bats. Some attempts have been to coat or wrap the exterior of the metal bat with materials such as carbon reinforcing fibers to enhance batting performance. These externally wrapped bats have been found to be aesthetically unpleasant and lacking in significant improvement. Other attempts have been made to insert internal layers or compartments within the metal bat to improve performance. Such designs include utilizing multiple-layered graphite inserts to provide durability and flexibility to the bat, tubular coiled spring steel inserts to improve the spring-board effect when the ball contacts the bat, and pressurized air chambers within the bat. While providing benefits, these designs also have drawbacks. Some designs are very expensive to manufacture and are prone to structural failure. The composite sheaths break down over time and the bats are subject to premature longitudinal cracks in the barrel of the bat. In many of the newly designed metal bats, the reinforcement is focused around the optimal hitting area or center of the hitting area of the bat and do not run the length of the barrel of the bat.

Accordingly, there is a need for a bat which enhances the performance of the bat and overcomes the disadvantages previously experienced with metal bats. The present invention fulfills these needs and provides other related advantages.

SUMMARY OF THE INVENTION

The present invention resides in a vibration damping baseball bat that includes a barrel portion, a handle portion, and interconnects the barrel portion and the handle portion in an aligned and spaced-apart relation. The mechanism by which the barrel and handle portions are interconnected dampens vibrations created when a ball contacts the bat and provides limited pivotal movement of the barrel portion relative to the handle portion.

The bat includes a first elastomeric washer disposed between the interconnecting mechanism and the barrel portion, and a second elastomeric washer disposed between the interconnecting mechanism and the handle portion.

The interconnecting mechanism forms a tapered portion of the bat and includes an intermediate tapered section having first and second engaging members connected to, respectively, the barrel portion and the handle portion. In this manner, the first elastomeric washer is disposed between the tapered section and the barrel portion and the second elastomeric washer is disposed between the tapered section and the handle portion.

The interconnecting mechanism includes a plug positioned within the barrel portion to receive the first engaging member. This barrel plug is sized and shaped to abuttingly engage the barrel portion when receiving the first engaging member. The barrel plug expands to wedge against the barrel portion as the plug receives the first engaging member. Threads within the barrel plug engage threads of the first engaging member, causing the plug to spread.

Likewise, the interconnecting mechanism includes a plug positioned within the handle portion to receive the second engaging member. This handle plug is sized and shaped to abuttingly engage the handle portion when receiving the second engaging member. The handle plug expands to wedge against the handle portion as the plug receives the second engaging member. Threads within the handle plug engage threads of the second engaging member, causing the plug to spread.

The tapered section is comprised of an elastomeric material to dampen vibrations created when a ball contacts the bat.

The barrel and handle portions each include a tapered first end having an aperture. The barrel and handle plugs are each tapered and disposed within their respective portions of the bat near the aperture of that portion. Each plug abuttingly engages, respectively, the tapered first end of its respective portion when receiving the interconnecting mechanism.

The interconnecting mechanism includes a mechanism for adjusting weight distribution of the bat. This adjustment mechanism includes a sleeve extending between the handle and barrel portions and a threaded rod received within the sleeve. A pair of threaded washers engage ends of the threaded rod that extend past the sleeve such that movement of at least one washer along the threaded rod adjusts weight distribution of the bat.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
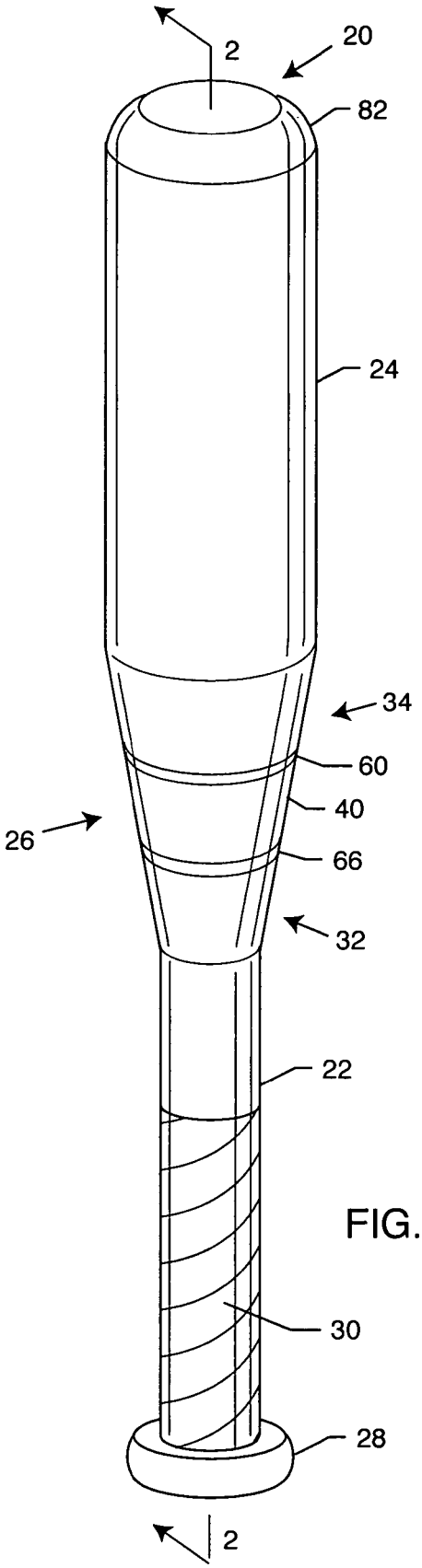
FIG. 1 is a perspective view of a bat embodying the present invention.
Figure 2:
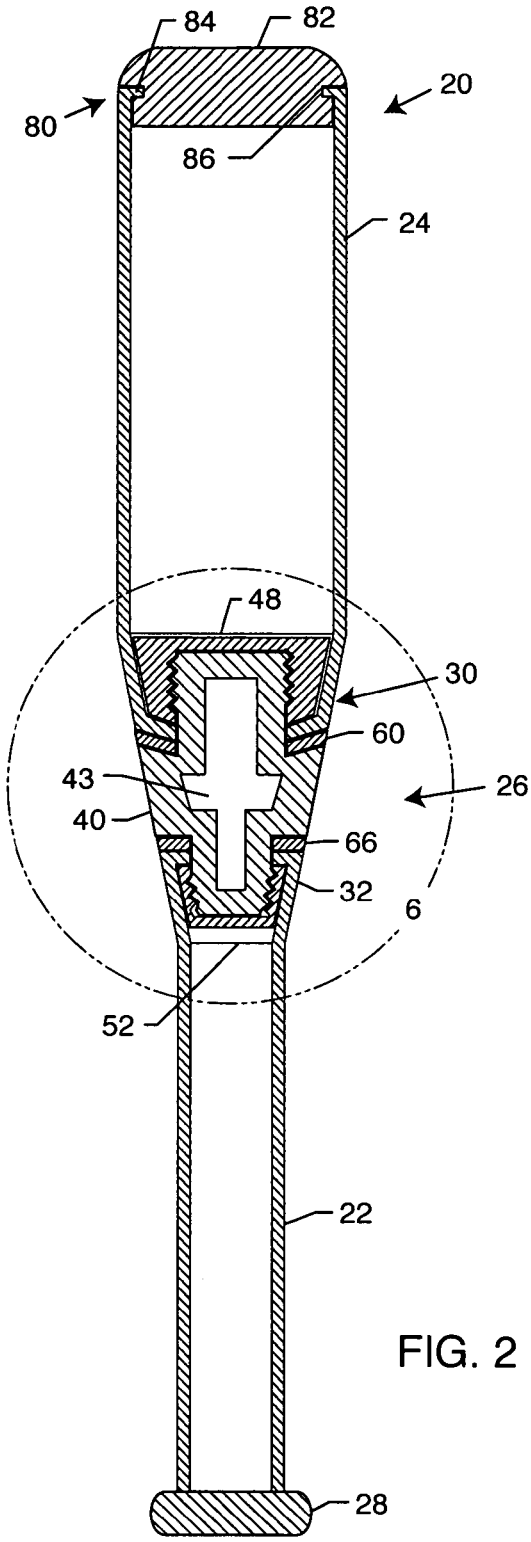
FIG. 2 is a cross-sectional elevation view of the bat of FIG. 1 showing the handle, barrel and mechanism for interconnecting the barrel and handle.
Figure 3:
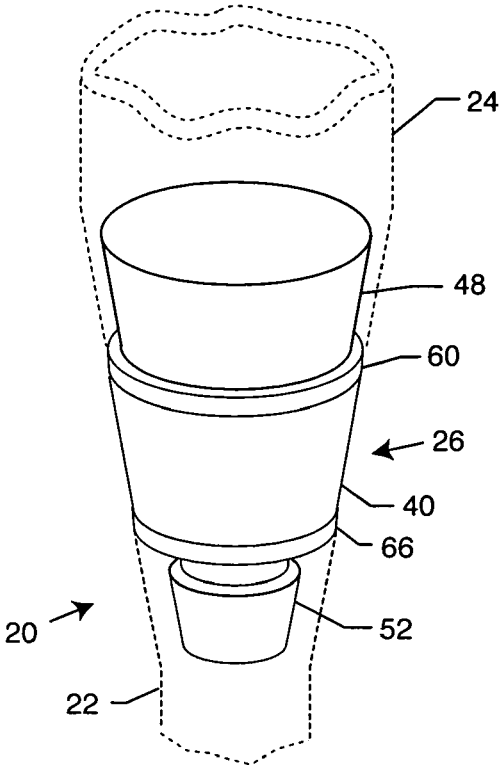
FIG. 3 is a perspective view of the interconnecting mechanism of FIG. 2 with the bat shown in phantom.
Figure 4:
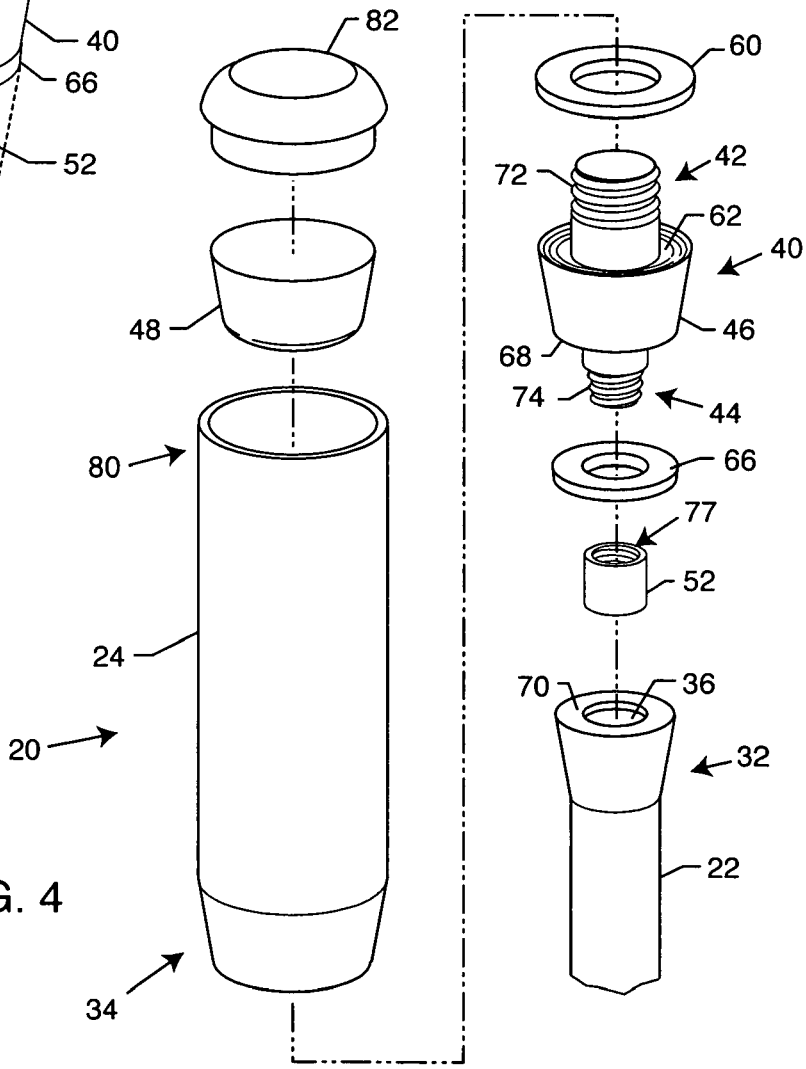
FIG. 4 is an exploded perspective view of the handle, barrel and interconnecting mechanism.
Figure 7:
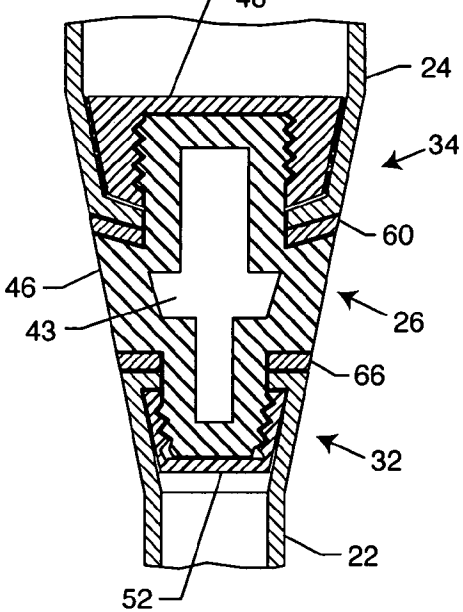
FIGS. 5–7 are cross-sectional elevation views showing the assembly of the bat by connecting the handle and the barrel using the interconnecting mechanism.
Figure 6:
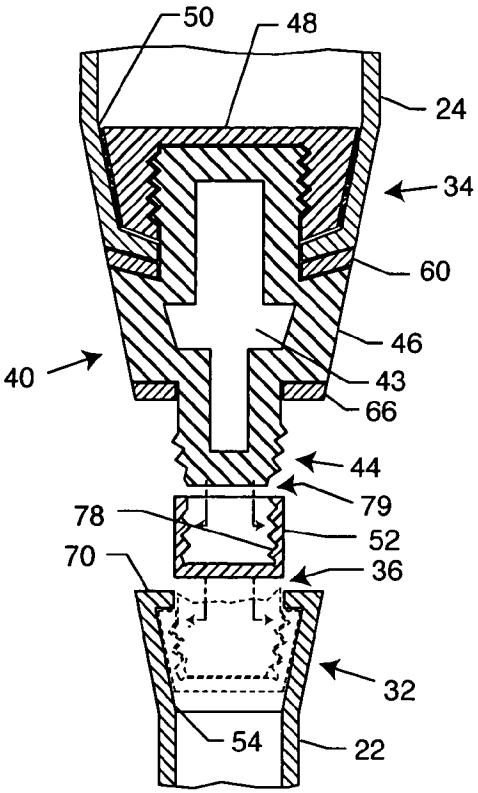
Figure 5:
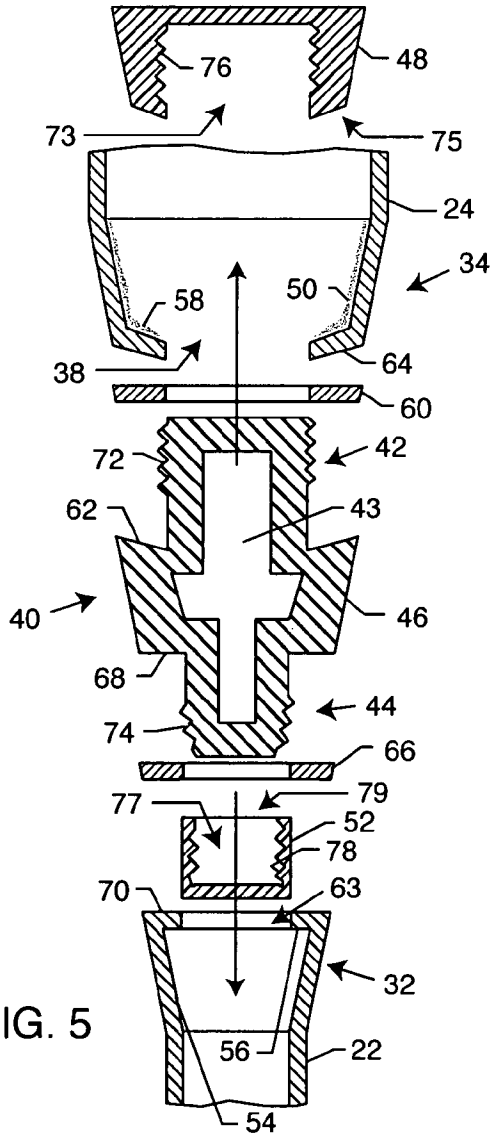
Figure 8:
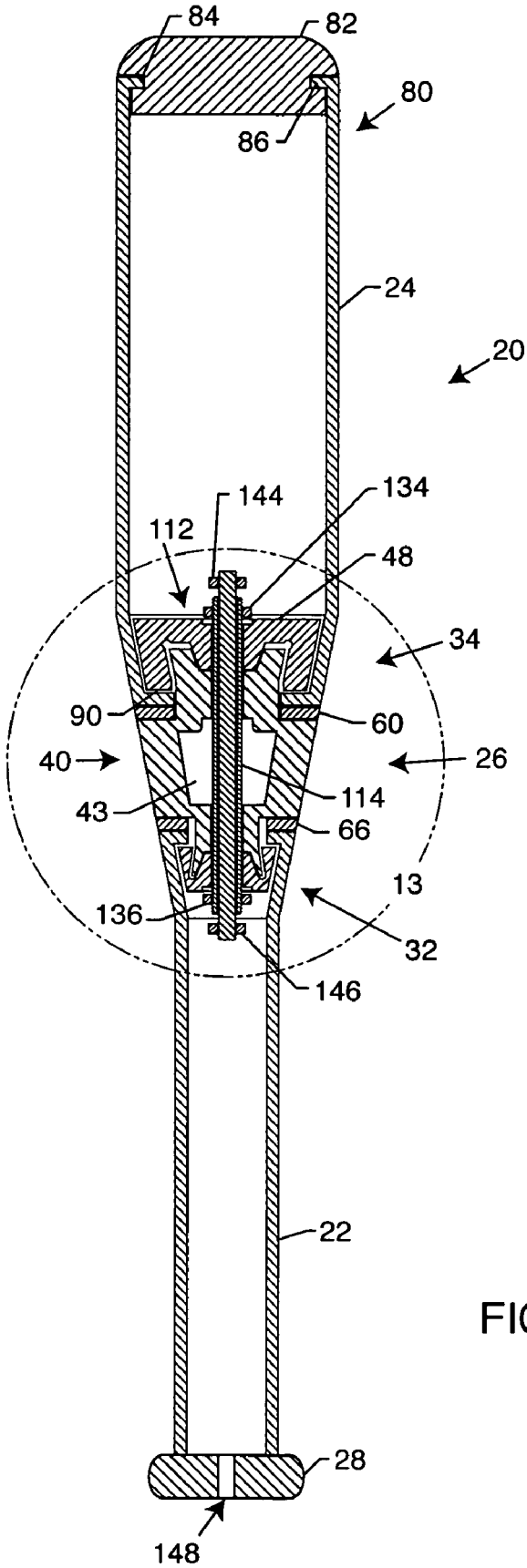
FIG. 8 is a cross-sectional elevation view of another bat embodying the present invention that shows the handle, barrel and mechanism for interconnecting the barrel and handle.
Figure 9:
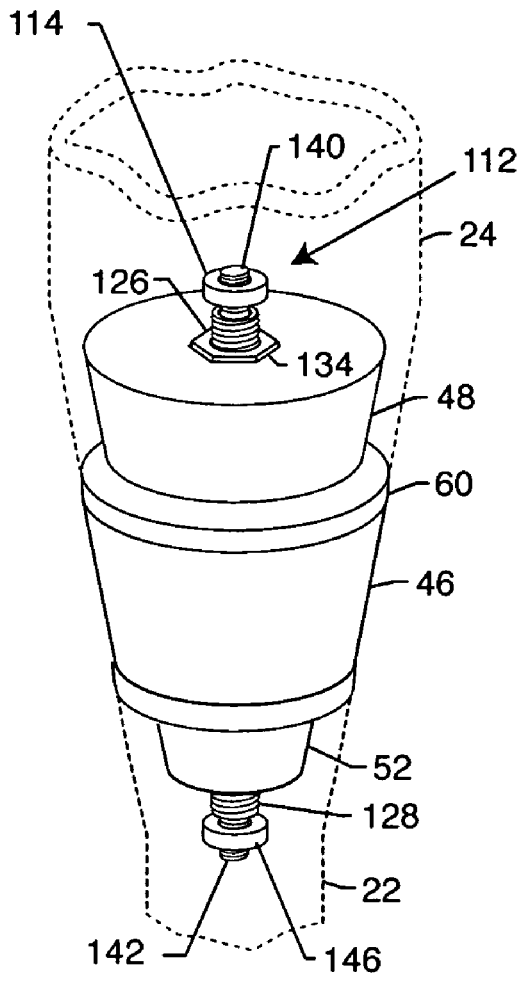
FIG. 9 is a perspective view of the interconnecting mechanism of FIG. 8 with the bat shown in phantom.
Figure 10:
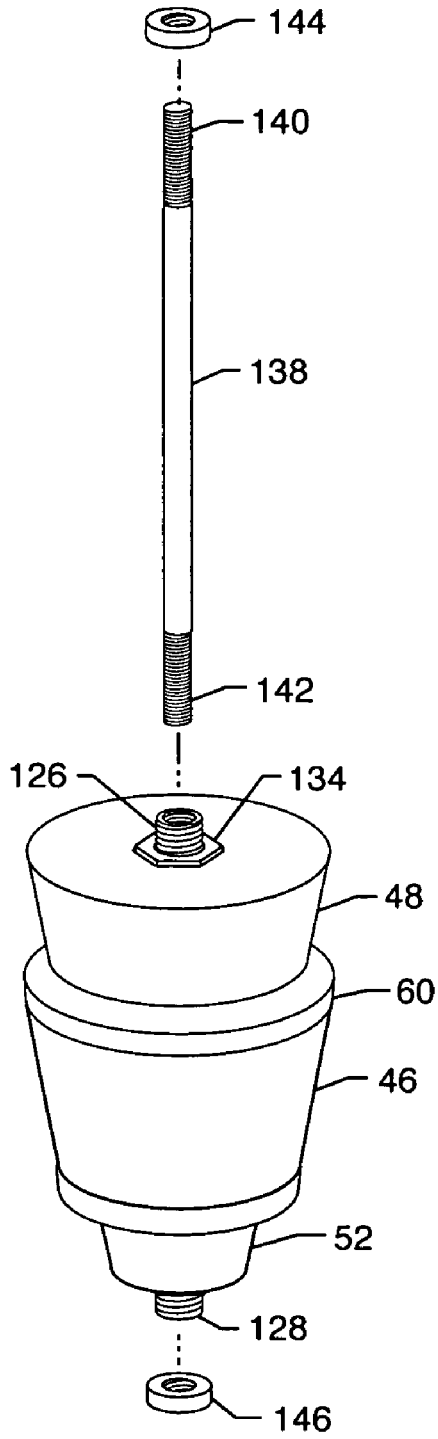
FIG. 10 is a partially exploded perspective view of the interconnecting mechanism of FIG. 9.
Figure 11:
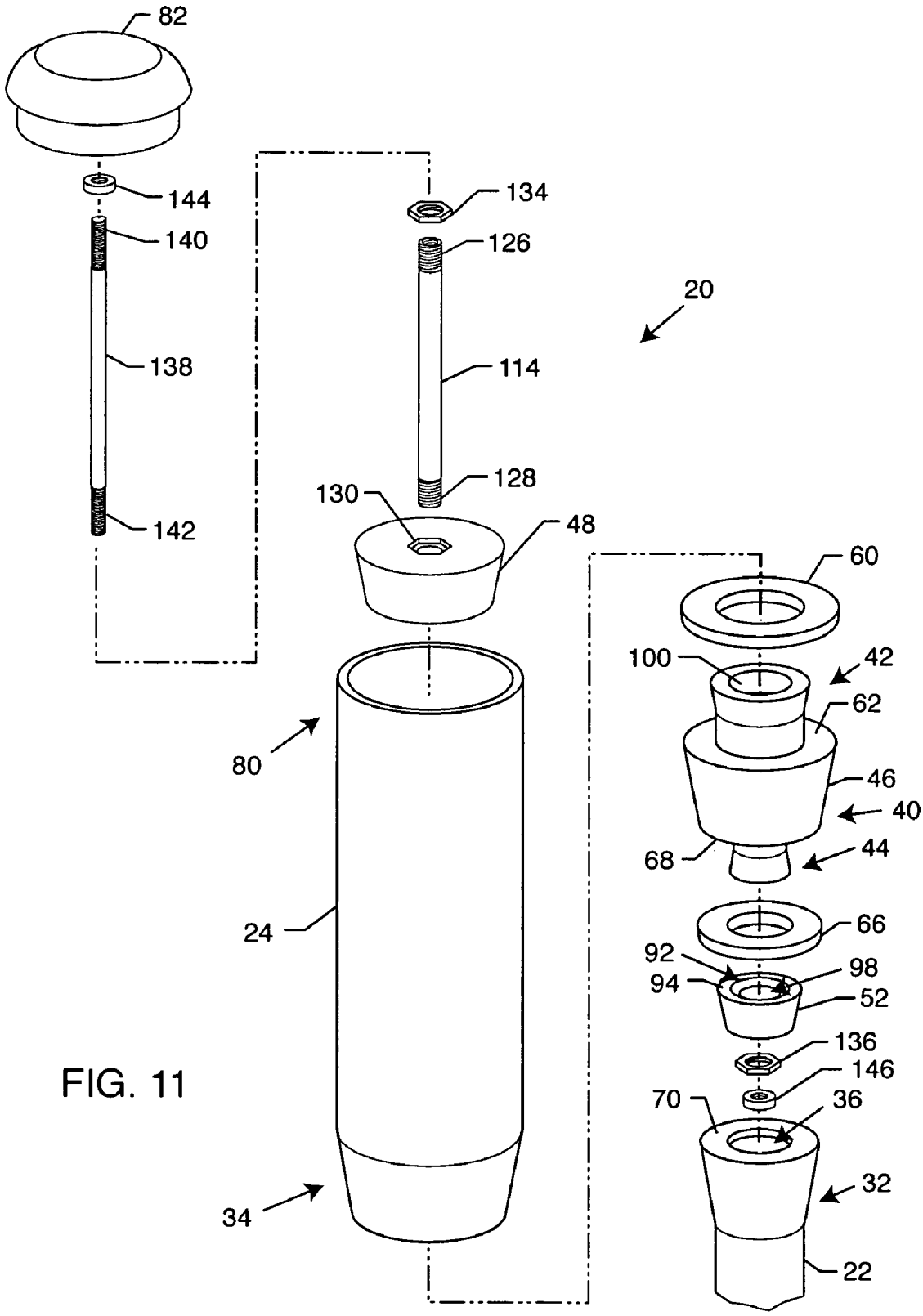
FIG. 11 is an exploded perspective view of the handle, barrel and interconnecting mechanism of the bat of FIG. 8.
Figure 12:
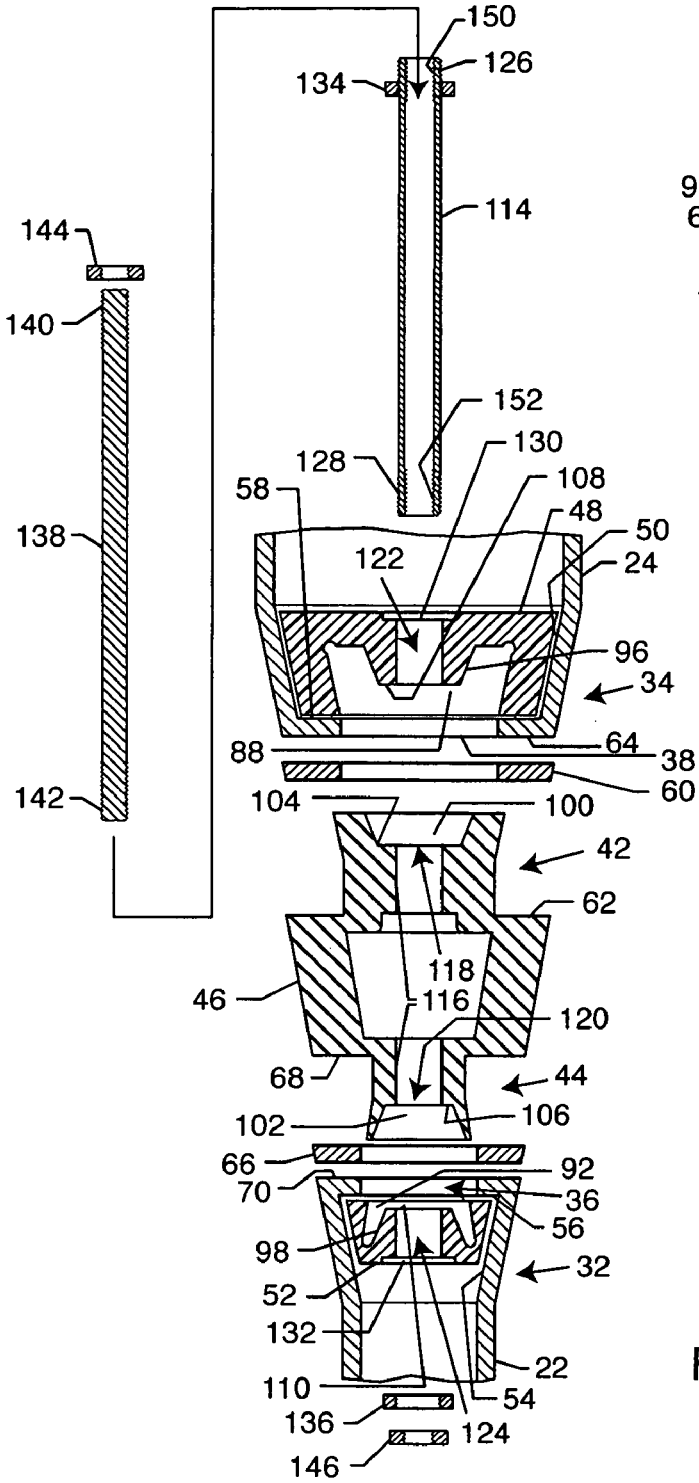
FIGS. 12 and 13 are cross-sectional elevation views showing the assembly of the bat of FIG. 8 by connecting the handle and the barrel using the interconnecting mechanism.
Figure 13:
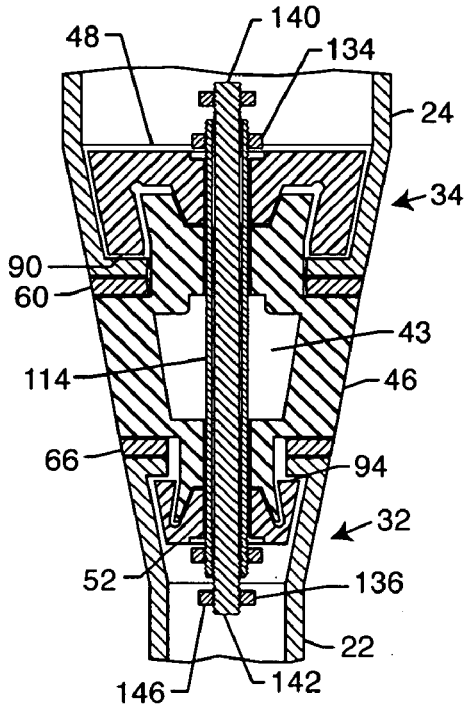

As shown in FIGS. 1–13 for purposes of illustration, the present invention is concerned with a bat 20 for use in baseball or softball, having an elongate hollow handle shell portion 22, an elongate hollow barrel shell portion 24 and an intermediate cylindrically tapered section 26 interconnecting the handle portion 22 and the barrel portion 24. A knob 28 may be welded or otherwise securely attached to the end of the handle portion 22. The knob 28 may be made of various materials including, without limitation, aluminum, polyurethane, polycarbonate, a composite material or the like. Also, the handle portion 22 is typically wrapped with a grip 30 comprised of rubber, polyurethane, leather or the like, for comfort. The construction of the intermediate tapered section 26 dampens vibrations created when a ball contacts the bat 20 and provides limited pivotal movement of the barrel portion 24 relative to the handle portion 22.

The handle and barrel portions 22, 24 may be made of various materials including, without limitation, wood, a lightweight yet durable metal (e.g., aluminum, titanium, magnesium, or an alloy thereof, a composite material (e.g., fiberglass, carbon fibers, or a combination of glass and carbon fibers) or the like. Preferably, the handle and barrel portions 22, 24 are comprised of a 6000 or 7000 series aluminum alloy in which zinc is the major alloying element coupled with a smaller percentage of magnesium, resulting in a heat-treatable alloy of very high strength. The handle and barrel portions 22, 24 are finished to a mechanical strength of T6 Temper.

The handle and barrel portions 22, 24 each include a tapered first end 32, 34 having an aperture 36, 38. The intermediate tapered section 26 includes a central tapered connector 40 having generally cylindrical first and second engaging members 42, 44 and a central cylindrically tapered section 46 disposed therebetween. The tapered connector 40 is hollow and includes a central cavity 43 within the central section 46 and the engaging members 42, 44. The diameters of the engaging members 42, 44 may be the same, or the diameter of one of the engaging members 42, 44 may be larger than the diameter of the other of the engaging members 44, 42.

A plug 48 positioned within the barrel portion 24 receives the first engaging member 42. This barrel plug 48 is sized and shaped to abuttingly engage the barrel portion 24 when receiving the first engaging member 42. The barrel plug 48 expands to wedge against an interior wall 50 of the barrel portion 24 as the plug 48 receives the first engaging member 42. Likewise, a plug 52 positioned within the handle portion 22 receives the second engaging member 44. This handle plug 52 is sized and shaped to abuttingly engage the handle portion 22 when receiving the second engaging member 44. The handle plug 52 expands to wedge against an interior wall 54 of the handle portion 22 as the plug 52 receives the second engaging member 44.

The barrel and handle plugs 48, 52 are disposed within the interior of their respective portions 24, 22 of the bat 20 near the aperture 38, 36 of that portion 24, 22. The end 32, 34 of each portion 22, 24 is curled or turned inwardly to create, respectively, an interior shoulder 56, 58 about the aperture 36, 38. Each plug 52, 48 abuttingly engages, respectively, the shoulder 56, 58 and interior wall 54, 50 of the portion 22, 24 when the plug 52, 48 receives its respective engaging member 44, 42 of the connector 40.

A generally continuous taper is formed on the exterior surface of the intermediate tapered section 26 by the tapered end 34 of the barrel portion 24, a first tapered cylindrical elastomeric washer 60 disposed between a shoulder 62 of the central section 46 and an exterior shoulder 64 of the tapered first end 34 of the barrel portion 24, the central section 46 of the tapered connector 40, a second tapered cylindrical elastomeric washer 66 disposed between another shoulder 68 of the central section 46 and an exterior shoulder 70 of the tapered first end 32 of the handle portion 22, and the tapered end 32 of the handle portion 22. The components of the intermediate tapered section 26 tightly fit together to isolate vibrations which insulates the handle portion 22 from vibrations generated in the barrel portion 24 when a ball strikes the barrel portion 24. The length of the intermediate tapered section 26 will be varied based on the size and type of bat (e.g., adult baseball bat, youth baseball bat, softball bat or the like). A high strength bonding glue (not shown) may be applied to all joins to secure all the connections.

The tapered connector 40 is comprised of a material to dampen vibrations created when a ball contacts the bat; isolating shock transmission from the barrel portion 24 to a hand of a batter gripping the handle portion 22 when a ball is in contact with the bat 20. This material comes in various forms including, without limitation, an elastomeric material (e.g., solid rubber, high performance rubber foam, silicone or similar materials), polyurethane, polycarbonate, or a composite material (e.g., fiberglass, carbon fibers, or a combination of glass and carbon fibers). The plugs 48, 52 and washers 60, 66 may be made of the same materials as the connector 40.

An end 80 of the barrel portion 24 is typically open and directed inward for acceptance and retention of an end plug 82. The end plug 82 is typically comprised of urethane, polyurethane, Zytel or the like. The end plug 82 has a circumferential groove 84 which accepts the inwardly directed annular lip 86 of the barrel portion 24.

As can be seen from FIGS. 1–7, in one embodiment of the present invention, each engaging member 42, 44 is generally cylindrical and includes exterior threads 72, 74 for engaging, respectively, the plugs 48, 52 of the barrel and handle portions 24, 22.

The barrel plug 48 is cylindrical tapered with a threaded bore 73 opening on an angled end 75. The angle of the end 75 matches the angle of the interior shoulders 58 of the first end 34 of the barrel portion 24; the angle of the end 75 being between zero and forty-five degrees. The angle of the exterior shoulder 64 of the barrel portion 24 matches the angle of the exterior shoulder 62 of the central section 46;

the angle of the exterior shoulder 62 being between zero and forty-five degrees. The washer 60 disposed between the shoulder 62 of the central section 46 and the exterior shoulder 64 of the first end 34 of the barrel portion 24 is compressed and bends to match this angle as the tapered connector 40 is connected to the barrel portion 24.

The handle plug 52 includes a cylindrical threaded bore 77 opening on an angled end 79. The angle of the end 79 matches the angle of the interior shoulder 56 of the first end 32 of the handle portion 22; the angle of the end 79 being between zero and forty-five degrees. The angle of the exterior shoulder 70 of the handle portion 22 matches the angle of the exterior shoulder 68 of the central section 46; the angle of the exterior shoulder 68 being between zero and forty-five degrees. The washer 66 disposed between the shoulder 68 of the central section 46 and the exterior shoulder 70 of the tapered first end 32 of the handle portion 22 is compressed and bends to match this angle as the tapered connector 40 is connected to the handle portion 22.

Interior threads 76, 78 within bores 73, 77 of the plugs 48, 52 engage, respectively, the exterior threads 72, 74 of its engaging member 42, 44. As the engaging members 42, 44 are threadedly received within the respective plug 48, 52, the plug 48, 52 begins to spread until the plug 48, 52 abuts against the interior walls 50, 54 and shoulders 58, 56. In the alternative, sides of the plugs 48, 52 may be comprised of a number of fingers (not shown) that spread to abut against the interior walls 50, 54 and shoulders 58, 56 as the engaging members 42, 44 are received within the respective plug 48, 52.

The bat 20 may be assembled in a number of ways. In one particular way, the barrel plug 48 is inserted through the open end 80 of the barrel portion 24 and positioned adjacent the aperture 38. The diameter of the plug 48 is larger than the diameter of the aperture 38 so the plug 48 will not go through the aperture 38. The handle plug 52 is inserted through the aperture 36 of the handle portion 22. The diameter of the plug 52 is the same or smaller than the diameter of the aperture 36 but larger than the diameter of the handle portion 22 past the tapered end 32 so the plug 52 will not go through the handle portion 22 towards the knob 28.

The first washer 60 is positioned around the first engaging member 42 and disposed between the shoulder 62 of the central section 46 and the exterior shoulder 64 of the tapered first end 34 of the barrel portion 24. The second washer 66 is positioned around the second engaging member 44 and disposed between the shoulder 68 of the central section 46 and the exterior shoulder 70 of the tapered first end 32 of the handle portion 22. The engaging members 42, 44 are threadedly engaged to their respective plugs 48, 52 until the barrel and handle portions 24, 22 are tightly connected together by the tapered connector 40. The end plug 82 is then secured to the end 80 of the barrel portion 24.

In another embodiment of the present invention, as seen in FIGS. 8–13, each engaging member 42, 44 is generally cylindrical and of constant diameter from where the engaging member 42, 44 is adjacent the central section 46 to about half its length when the engaging member 42, 44 tapers outwardly for the rest of its length.

The barrel plug 48 is cylindrically tapered with a smooth-walled tapered bore 88 opening on an angled end 90. The angle of the end 90 matches the angle of the interior shoulders 58 of the first end 34 of the barrel-portion 24; the angle of the end 90 being between zero and forty-five degrees. The angle of the exterior shoulder 64 of the barrel portion 24 matches the angle of the exterior shoulder 62 of the central section 46; the angle of the exterior shoulder 62 being between zero and forty-five degrees. The washer 60 disposed between the shoulder 62 of the central section 46 and the exterior shoulder 64 of the first end 34 of the barrel portion 24 is compressed and bends to match this angle as the tapered connector 40 is connected to the barrel portion 24.

The handle plug 52 is cylindrically tapered with a smooth-walled tapered bore 92 opening on an angled end 94. The angle of the end 94 matches the angle of the interior shoulder 56 of the first end 32 of the handle portion 22; the angle of the end 94 being between zero and forty-five degrees. The angle of the exterior shoulder 70 of the handle portion 22 matches the angle of the exterior shoulder 68 of the central section 46; the angle of the exterior shoulder 68 being between zero and forty-five degrees. The washer 66 disposed between the shoulder 68 of the central section 46 and the exterior shoulder 70 of the tapered first end 32 of the handle portion 22 is compressed and bends to match this angle as the tapered connector 40 is connected to the handle portion 22.

Interior cylindrically tapered mounds 96, 98 within bores 88, 92 of the plugs 48, 52 engage, respectively, cylindrically tapered receptacles 100, 102 of its engaging member 42, 44. When the engaging member 42, 44 is fully received within the bore 88, 92 of the respective plug 48, 52, an end 104, 106 of the receptacle 100, 102 abuts against an end 108, 110 of mound 96, 98. In the alternative, sides of the plugs 48, 52 may be comprised of a number of fingers (not shown) that spread to abut against the interior walls 50, 54 and shoulders 58, 56 as the engaging members 42, 44 are received within the respective plug 48, 52.

The tapered connector 40 and plugs 48, 52 are held together by press-fit engagement as well as by a mechanism for adjusting weight distribution 112 of the bat 20. This adjustment mechanism 112 includes a sleeve 114 extending between the handle and barrel portions 22, 24 through a central bore 116 in the tapered connector 40 that has openings 118, 120 in the receptacles 100, 102 of the engaging members 42, 44. Each plug 48, 52 also includes a central bore 122, 124 through which the sleeve 114 extends. Exterior ends 126, 128 of the sleeve 114 are threaded. Each plug 48, 52 includes a shallow hexagonal recess 130, 132 for receiving a threaded hexagonal washer 134, 136 that engages a respective threaded end 126, 128 of the sleeve 114. The engagement of the washers 134, 136 and sleeve 114 help connect the tapered connector 40 and plugs 48, 52 together.

A rod 138 with threaded ends 140, 142 is received within and extends past the ends 126, 128 of the sleeve 114. Interior portions 150, 152 of the ends 126, 128 of the sleeve 114 are threaded to engage the threads of the threaded ends 140, 142 of the rod 138 and hold the rod 138 in position relative to the sleeve 114 until otherwise adjusted by a user. In the alternative, the entire exterior surface of the rod 138 may be threaded. In another alternative, the entire interior surface of the sleeve 114 may be threaded. A pair of threaded washers 144, 146 engage the threaded ends 140, 142 of the rod 138 that extend past the sleeve 114 such that movement of at least one washer 144, 146 along the threads of the rod 138 adjusts the weight distribution of the bat 20. In a further alternative, the interior surface of the sleeve 114 may be smooth bored so as to allow the rod 138 to slidably move within the sleeve 114, the rod 138 being held in place by the washers 144, 146 on the ends 140, 142 of the rod 138. The washers 144, 146 may be the same weight or different weights. In this manner, centripetal acceleration would cause the rod 138 to slide within the sleeve 114 when the bat 20 is swung by a user, as well as causing mass of the bat 20 to shift between the handle and barrel portions 22, 24.

The bat 20 may be assembled in a number of ways. In one particular way, the barrel plug 48 is inserted through the open end 80 of the barrel portion 24 and positioned adjacent the aperture 38. The diameter of the plug 48 is larger than the diameter of the aperture 38 so the plug 48 will not go through the aperture 38. The washer 134 is threadedly engaged to the sleeve 114 and the sleeve 114 inserted into the plug bore 122 until the washer 134 is fully received within the recess 130. The washer 144 is threadedly engaged to the rod 138 and the rod 138 inserted into the sleeve 114. The first washer 60 is positioned around the first engaging member 42 and disposed between the shoulder 62 of the central section 46 and the exterior shoulder 64 of the tapered first end 34 of the barrel portion 24.

The sleeve 114 (and the rod 138 within and extending beyond the sleeve 114) pass through the central bore 116 and openings 118, 120 of the tapered connector 40 when the first engaging member 42 is received within the plug 48.

The tapered handle plug 52 is inserted one of the open ends of the handle portion 22 with the sides of the tapered plug 52 being compressed as necessary to position the plug 52 within the handle portion 22. The taper of the plug 52, once positioned, prevents the plug 52 from going through the handle portion 22 towards the knob 28 or through the aperture 36 of the handle end 32. Once the plug 52 is in position, the second washer 66 is positioned around the second engaging member 44 and disposed between the shoulder 68 of the central section 46 and the exterior shoulder 70 of the tapered first end 32 of the handle portion 22. The second engaging member 44 is then received within the plug 52 with the sleeve 114 (and the rod 138 within and extending beyond the sleeve 114) passing through the bore 124 of the plug 52. The washers 136, 146 are then connected, respectively, to the sleeve 114 and rod 138 with the barrel and handle portions 24, 22 being connected together thereby. The end plug 82 is then secured to the end 80 of the barrel portion 24.

The interconnection of the handle portion 22 and the barrel portion 24 improves and amplifies the spring-board effect when the ball contacts the bat 20 by allowing the bat 20 to bend along the intermediate section 28 upon impact and then springing back to its original shape. The intermediate section 26 also reduces vibrations in that the components of the intermediate section 26 deflects, absorb and isolate vibrations traveling along the length of the barrel portion 24 towards the handle portion 22, thus reducing the vibration created when a ball contacts the bat 20. The width and depth of the intermediate section 26 can be varied to obtain the ultimate performance of the bat, depending on the design of the bat. The diameters and thicknesses of the handle portion 22, barrel portion 24 and intermediate section 26 can be varied to alter the characteristics and performance of the bat 20.

The knob 28 includes a bore 148 that allows an Allen wrench to be inserted into the handle portion 22 to engage and adjust the position of the rod 138 within the sleeve 114.

An example of one particular method of manufacturing the bat 20 of the present invention will now be described. It is to be understood that the following method may be altered in some respects while still creating a bat 20 having the desired characteristics. Also, certain dimensions, materials, temperatures, etc. may be altered depending upon the size, weight and intended use of the resulting bat 20. Accordingly, a softball bat having a length of 34 inches and weighting 28 ounces will be described by way of example in connection with the manufacturing method.

Metal tubes, such as aluminum alloy tubes, are provided at predetermined lengths and weights prior to manufacturing. For purposes of the following example, aluminum alloy tubes are provided for the handle and barrel portions 22, 24.

Figure 14:
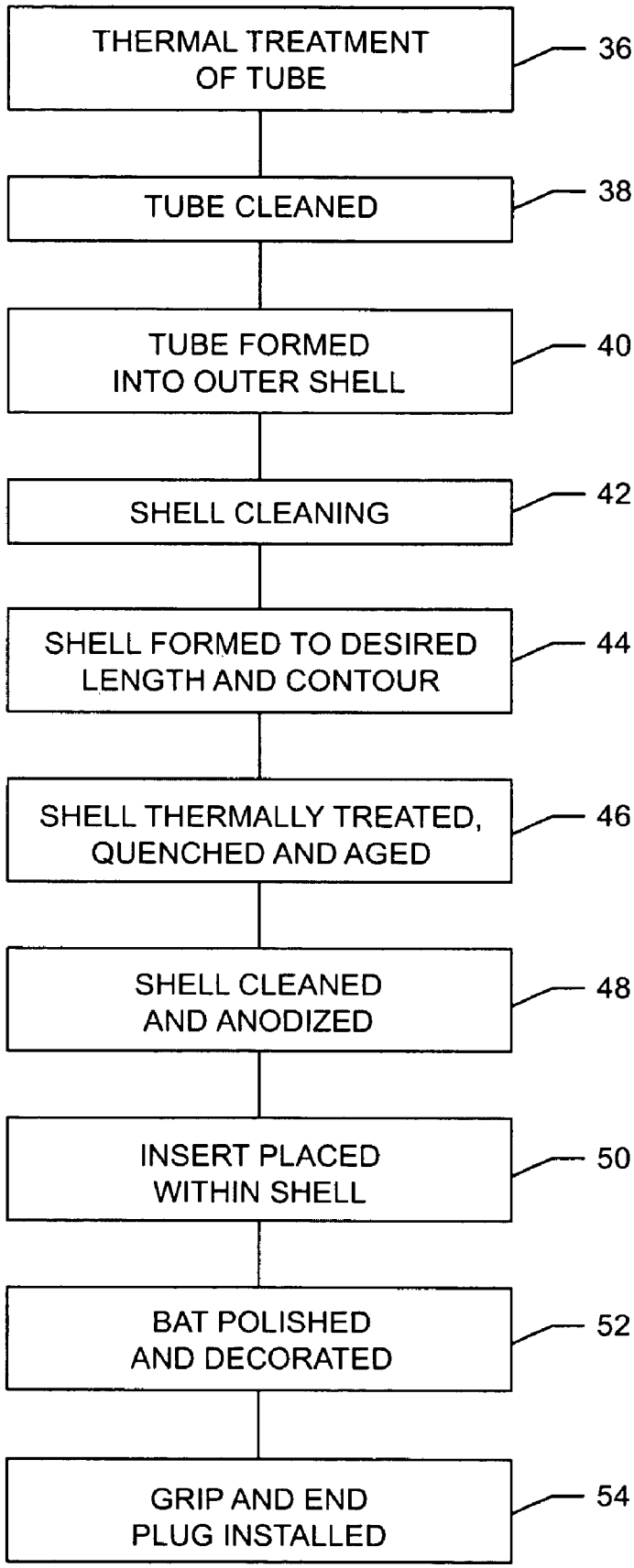
FIG. 14 is a flow chart illustrating the steps taken in manufacturing the bat of the present invention.

With reference to FIG. 14, the metal tubes are first thermally treated (36). This is often referred to in the art as an annealing process. The thermal treatment softens the metal by removing the stress resulting from cold working. This process is to be repeated after a certain amount of cold work has been performed on the metal tubes. Before each cold forming process, the temperature of an anneal oven is set at 410° C. The aluminum tubes are heated in the oven at this temperature for approximately three hours. The oven temperature is then decreased by 20° C. per hour, after the three hour soak time, until the temperature of the tubes has reached 20° C. The aluminum tubes are then heated at a temperature of 230° C. for two hours, at which point the oven temperature is reset to 140° C. The tubes are removed from the oven when the temperature of the oven has reached 140° C.

The tubes are then cleaned (38). During the annealing process, an oxidation scale develops on the surface of the aluminum tubes. An acid cleaning process is required to remove the oxidation scale. The tubes are soaked in a sulfuric acid solution for approximately thirty minutes to remove the oxidation scale each time the tubes are annealed.

The tubes are then formed into handle and barrel portions 22, 24 of desired thickness, contour and length (40). This wall forming process is a cold working process. It is performed to obtain a wall of a desired thickness. Several cold forming passes may have to be performed depending upon several factors including metal type and the type of bat 20 desired. In the instant example, the tubes forming the aluminum handle and barrel portions 22, 24 are subject to the cold working process on the outside diameter and the wall thickness simultaneously to obtain a wall thickness of 0.055 inches with a tolerance of +/−0.003 inches.

The portions 22, 24 are then cleaned (42). A degreasing process is required to remove all lubricants and residue substances out of the aluminum portions 22, 24. This is performed using an ultrasonic method with a detergent agent before and after the aluminum tube is annealed.

The portions 22, 24 are then cut, trimmed and swaged to a desired length and contour (44). A thin end of each aluminum portion 22, 24 is trimmed to a predetermined length. It is important to have the thin ends of the aluminum portions 22, 24 squarely trimmed to avoid folding problems when the tubes are swaged by a rotary taper swager. The aluminum portions 22, 24 are swaged with a rotary swaging machine to obtain the desired contour shape and wall thickness. In the instant example, the required wall thickness after swaging is generally 0.055 inches with a tolerance of +/−0.002 inches for the barrel portion 24. The required wall thickness for the handle portion 22 is generally 0.085 inches with a tolerance of +/−0.002 inches. The rotary swaging machine also contours the tapered ends 32, 34 of the handle 22 and barrel 24 portions.

The tapered connector 40, plugs 48, 52, and washers 60, 66 may be formed using conventional methods which may vary according to whether a bat 20 of FIGS. 1–7 or a bat 20 of FIGS. 8–13 is desired. The tapered connector 40 is shaped to obtain a desired contoured shape.

If necessary, after shaping, the handle and barrel portions 22, 24 are cut to the desired length. In the instant example, the total required length of the bat 20 is 34.5 inches and the weight is 17 ounces. From the end of the barrel portion 24 to an index is 19.5 inches, and from the index to the end of the handle portion 22 is 15 inches.

The handle and barrel portions 22, 24 are then thermally treated, quenched and aged (46). It is commonly known in the art to expose metal or alloys to a heating and cooling treatment to obtain desired conditions, properties and an increase in strength. The handle and barrel portions 22, 24 are heat treated to obtain the highest tensile and yield strengths. The required temperature and time for the solution heat treatment is twenty-seven minutes at a temperature of 480° C. After the handle and barrel portions 22, 24 are heat treated, they are quenched immediately with either air or water. Quenching is a controlled rapid cooling of a metal from an elevated temperature by contact with a liquid, gas or solid. Precipitation from solid solution results in a change in properties of the alloy, usually occurring rapidly at elevated temperatures. The handle and barrel portions 22, 24 are aged in an oven for twelve hours at 135° C.

The handle and barrel portions 22, 24 are then cleaned again (48). Due to the treatments in step 510, the handle and barrel portions 22, 24 oxidize. This oxidation is removed by an anodizing process. The handle and barrel portions 22, 24 are anodized for five minutes. To eliminate all possible contaminations, the surface of the handle and barrel portions 22, 24 are then thoroughly cleaned with methyl ethyl ketone.

At this point, the handle and barrel portions 22, 24 are assembled as outlined above, with respect to FIGS. 1–7 and FIGS. 8–13.

Thereafter, approximately a 0.50 inch portion of the open barreled end 80 is rolled inward at a 90° angle to accommodate the end plug 82. If necessary, the protruded portion of the rolled portion is machined to achieve an opening of 1.25 inches in diameter for installing the end plug 82.

The bat 20 is then polished and decorated (52). Any appropriate methods of polishing and decoration, as are well known in the art, can be applied. In the preferred embodiment, the outer surfaces of the handle and barrel portions 22, 24 are exposed to sodium hydroxide to strip an anodize coating created during the manufacturing process as well as to prepare the outer surface for anodic coating process. Typically, the concentration of the sodium hydroxide is fifty grams per liter. The outer surface of the handle and barrel portions 22, 24 are mechanically polished to obtain a mirror finish. The external surface of the handle and barrel portions 22, 24 are then anodized. In the alternative, the external surface of the handle and barrel portions 22, 24 may be painted, chromed, powder-coated, or covered by some other method of decorative coating. The outer surface of the handle and barrel portions 22, 24 may be decorated with a graphic by using various methods such as silkscreening, heat transferring, or pad stamping.

The bat 20 is completed by attaching the knob 28, typically by welding a knob comprised of 5000 series or 6000 series aluminum alloy to an open end of the handle portion 22 opposite the tapered end 32. The grip 30 and the end plug 82 are also installed to finish the bat 20 (54).

In the alternative, the above described method of manufacturing the bat 20 may be varied. For example, physical characteristics of the bat 20, such as the length, wall thickness or diameter may be increased or decreased.

Although constructed from affordable medium to high strength, light weight, and commercially available materials, the bat 20 of the present invention offers the performance and advantages of expensive and high strength materials. The bat 20 provides improved dent resistance. The bat 20 also dampens the vibrations created when traditional metal bats hit the ball that would otherwise sting the hitter's hand when a bat contacts a ball. Premature longitudinal cracking of the barrel portion 24, caused in traditional bats with thin wall thicknesses and high stress conditions, is avoided in the present invention.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A vibration damping baseball bat, comprising:

a barrel portion including a tapered first end having an aperture;

a handle portion including a tapered second end having an aperture;

a first tapered plug disposed within the barrel portion near the aperture of the barrel portion;

a second tapered plug disposed within the handle portion near the aperture of the handle portion;

means for interconnecting the barrel portion and the handle portion in an aligned and spaced-apart relation, wherein the interconnecting means dampens vibrations created when a ball contacts the bat, provides limited pivotal movement of the barrel portion relative to the handle portion, and forms a continuous tapered exterior surface with the handle and barrel portions; wherein each plug abuttingly engages a respective tapered end when receiving the interconnecting means;

a first elastomeric washer disposed between the interconnecting means and the barrel portion; and a second elastomeric washer disposed between the interconnecting means and the handle portion.

2. The bat of claim 1, wherein the interconnecting means includes an intermediate continuously tapered frusto-conical section having first and second engaging members connected to, respectively, the barrel portion and the handle portion.

3. The bat of claim 2, wherein the first elastomeric washer is disposed between the tapered section and the barrel portion, and the second elastomeric washer is disposed between the tapered section and the handle portion.

4. The bat of claim 2, wherein the first tapered plug receives the first engaging member.

5. The bat of claim 2, wherein the second tapered plug receives the second engaging member.

6. The bat of claim 2, wherein the tapered section is comprised of an elastomeric material to dampen vibrations created when a ball contacts the bat.

7. The bat of claim 1, wherein the interconnecting means includes internal means for adjusting weight distribution of the bat.

8. The bat of claim 4, wherein the first tapered plug is sized and shaped to abuttingly engage the barrel portion when receiving the first engaging member, the first tapered plug expanding to wedge against the barrel portion as the first tapered plug receives the first engaging member.

9. The bat of claim 4, wherein threads within the first tapered plug engage threads of the first engaging member, causing the first tapered plug to spread.

10. The bat of claim 5, wherein the second tapered plug is sized and shaped to abuttingly engage the handle portion when receiving the second engaging member, the second tapered plug expanding to wedge against the handle portion as the second tapered plug receives the second engaging member.

11. The bat of claim 5, wherein threads within the second tapered plug engage threads of the second engaging member, causing the second tapered plug to spread.

12. The bat of claim 7, wherein the adjusting means includes a sleeve extending between the handle and barrel portions, a threaded rod received within the sleeve, and a pair of threaded washers that engage ends of the threaded rod that extend past the sleeve such that movement of at least one washer along the threaded rod adjusts weight distribution of the bat.

13. A vibration damping baseball bat, comprising:

a barrel portion;

a handle portion; and means for interconnecting the barrel portion and the handle portion in an aligned and spaced-apart relation, wherein the interconnecting means dampens vibrations created when a ball contacts the bat, provides limited pivotal movement of the barrel portion relative to the handle portion, and includes a plug positioned within the barrel portion to receive the first engaging member, wherein the plug is sized and shaped to abuttingly engage the barrel portion when receiving the first engaging member, the plug expanding to wedge against the barrel portion as the plug receives the first engaging member.

14. A vibration damping baseball bat, comprising:

a barrel portion;

a handle portion; and means for interconnecting the barrel portion and the handle portion in an aligned and spaced-apart relation, wherein the interconnecting means dampens vibrations created when a ball contacts the bat, provides limited pivotal movement of the barrel portion relative to the handle portion, and includes a plug positioned within the barrel portion to receive the first engaging member, wherein threads within the plug engage threads of the first engaging member, causing the plug to spread.

15. A vibration damping baseball bat, comprising:

a barrel portion;

a handle portion; and means for interconnecting the barrel portion and the handle portion in an aligned and spaced-apart relation, wherein the interconnecting means dampens vibrations created when a ball contacts the bat and provides limited pivotal movement of the barrel portion relative to the handle portion; the interconnecting means including an intermediate tapered section having first and second engaging members connected to, respectively, the barrel portion and the handle portion, and a plug positioned within the handle portion to receive the second engaging member, wherein the plug is sized and shaped to abuttingly engage the handle portion when receiving the second engaging member, the plug expanding to wedge against the handle portion as the plug receives the second engaging member.

16. A vibration damping baseball bat, comprising:

a barrel portion;

a handle portion; and means for interconnecting the barrel portion and the handle portion in an aligned and spaced-apart relation, wherein the interconnecting means dampens vibrations created when a ball contacts the bat and provides limited pivotal movement of the barrel portion relative to the handle portion; the interconnecting means including an intermediate tapered section having first and second engaging members connected to, respectively, the barrel portion and the handle portion, and a plug positioned within the handle portion to receive the second engaging member, wherein threads within the plug engage threads of the second engaging member, causing the plug to spread.

17. A vibration damping baseball bat, comprising:

a barrel portion;

a handle portion; and means for interconnecting the barrel portion and the handle portion in an aligned and spaced-apart relation, wherein the interconnecting means dampens vibrations created when a ball contacts the bat and provides limited pivotal movement of the barrel portion relative to the handle portion; the interconnecting means including means for adjusting weight distribution of the bat comprising a sleeve extending between the handle and barrel portions, a threaded rod received within the sleeve, and a pair of threaded washers that engage ends of the threaded rod that extend past the sleeve such that movement of at least one washer along the threaded rod adjusts weight distribution of the bat.

18. A vibration damping baseball bat, comprising:

a barrel portion;

a handle portion; and an intermediate continuously tapered frusto-conical section interconnecting the barrel portion and the handle portion in an aligned and spaced-apart relation, the intermediate tapered section having first and second engaging members connected to, respectively, the barrel portion and the handle portion, a plug positioned within the barrel portion to receive the first engaging member, and a plug positioned within the handle portion to receive the second engaging member, wherein the intermediate tapered section dampens vibrations created when a ball contacts the bat, provides limited pivotal movement of the barrel portion relative to the handle portion, and forms a continuous tapered exterior surface with the barrel and handle portions.

19. The bat of claim 18, including a first elastomeric washer disposed between the intermediate tapered section and the barrel portion and a second elastomeric washer disposed between the intermediate tapered section and the handle portion.

20. The bat of claim 18, wherein each plug is tapered, the barrel and handle portions each including a tapered first end having an aperture with the tapered plug disposed within the portion near that aperture, the tapered plug abuttingly engaging the tapered first end when receiving one of the first and second engaging members.

21. The bat of claim 18, wherein the plugs within the barrel portion and the handle portion are sized and shaped to abuttingly engage, respectively, the barrel portion and the handle portion when receiving, respectively, the first engaging member and the second engaging member, the barrel portion plug and the handle portion plug expanding to wedge against, respectively, the barrel portion and the handle portion as the plugs receive, respectively, the first engaging member and the second engaging member, threads within each plug engaging, respectively, threads of the first engaging member and the second engaging member, causing the plugs to spread.

22. The bat of claim 18, including a sleeve extending through the intermediate tapered section between the handle and barrel portions, a threaded rod received within the sleeve, and a pair of threaded washers that engage ends of the threaded rod that extend past the sleeve such that movement of at least one washer along the threaded rod adjusts weight distribution of the bat.

23. A vibration damping baseball bat, comprising:

a barrel portion;

a handle portion;

an intermediate tapered section interconnecting the barrel portion and the handle portion in an aligned and spaced-apart relation;

a first elastomeric washer disposed between the intermediate tapered section and the barrel portion; and a second elastomeric washer disposed between the intermediate tapered section and the handle portion; wherein the intermediate tapered section has first and second engaging members connected to, respectively, the barrel portion and the handle portion, a plug positioned within the barrel portion to receive the first engaging member, and a plug positioned within the handle portion to receive the second engaging member, wherein the intermediate tapered section dampens vibrations created when a ball contacts the bat and provides limited pivotal movement of the barrel portion relative to the handle portion.

24. A vibration damping baseball bat, comprising:

a barrel portion;

a handle portion;

an intermediate tapered section interconnecting the barrel portion and the handle portion in an aligned and spaced-apart relation; the intermediate tapered section having first and second engaging members connected to, respectively, the barrel portion and the handle portion, a plug positioned within the barrel portion to receive the first engaging member, and a plug positioned within the handle portion to receive the second engaging member, wherein the intermediate tapered section dampens vibrations created when a ball contacts the bat and provides limited pivotal movement of the barrel portion relative to the handle portion; wherein each plug is tapered, the barrel and handle portions each including a tapered first end having an aperture with the tapered plug disposed within the portion near that aperture, the tapered plug abuttingly engaging the tapered first end when receiving one of the first and second engaging members.

25. A vibration damping baseball bat, comprising:

a barrel portion;

a handle portion;

an intermediate tapered section interconnecting the barrel portion and the handle portion in an aligned and spaced-apart relation; the intermediate tapered section having first and second engaging members connected to, respectively, the barrel portion and the handle portion, a plug positioned within the barrel portion to receive the first engaging member, and a plug positioned within the handle portion to receive the second engaging member, wherein the intermediate tapered section dampens vibrations created when a ball contacts the bat and provides limited pivotal movement of the barrel portion relative to the handle portion; wherein the plugs within the barrel portion and the handle portion are sized and shaped to abuttingly engage, respectively, the barrel portion and the handle portion when receiving, respectively, the first engaging member and the second engaging member, the barrel portion plug and the handle portion plug expanding to wedge against, respectively, the barrel portion and the handle portion as the plugs receive, respectively, the first engaging member and the second engaging member, threads within each plug engaging, respectively, threads of the first engaging member and the second engaging member, causing the plugs to spread.

26. A vibration damping baseball bat, comprising:

a barrel portion;

a handle portion;

an intermediate tapered section interconnecting the barrel portion and the handle portion in an aligned and spaced-apart relation; and a sleeve extending through the intermediate tapered section between the handle and barrel portions, a threaded rod received within the sleeve, and a pair of threaded washers that engage ends of the threaded rod that extend past the sleeve such that movement of at least one washer along the threaded rod adjusts weight distribution of the bat; the intermediate tapered section having first and second engaging members connected to, respectively, the barrel portion and the handle portion, a plug positioned within the barrel portion to receive the first engaging member, and a plug positioned within the handle portion to receive the second engaging member, wherein the intermediate tapered section dampens vibrations created when a ball contacts the bat and provides limited pivotal movement of the barrel portion relative to the handle portion.

27. A vibration damping baseball bat, comprising:

a barrel portion;

a handle portion; and an intermediate tapered section interconnecting the barrel portion and the handle portion in an aligned and spaced-apart relation, the intermediate tapered section having first and second engaging members connected to, respectively, the barrel portion and the handle portion, and wherein the intermediate tapered section dampens vibrations created when a ball contacts the bat and provides limited pivotal movement of the barrel portion relative to the handle portion;

a plug positioned within the barrel portion to receive the first engaging member;

a plug positioned within the handle portion to receive the second engaging member, wherein the plugs within the barrel portion and the handle portion are sized and shaped to abuttingly engage, respectively, the barrel portion and the handle portion when receiving, respectively, the first engaging member and the second engaging member, the barrel portion plug and the handle portion plug expanding to wedge against, respectively, the barrel portion and the handle portion as the plugs receive, respectively, the first engaging member and the second engaging member, threads within each plug engaging, respectively, threads of the first engaging member and the second engaging member, causing the plugs to spread;

a first elastomeric washer disposed between the intermediate tapered section and the barrel portion;

a second elastomeric washer disposed between the intermediate tapered section and the handle portion;

a sleeve extending through the intermediate tapered section between the handle and barrel portions;

a threaded rod received within the sleeve; and a pair of threaded washers that engage ends of the threaded rod that extend past the sleeve such that movement of at least one washer along the threaded rod adjusts weight distribution of the bat.

* * * * *